US010252843B2

(12) United States Patent
Linton et al.

(10) Patent No.: US 10,252,843 B2
(45) Date of Patent: Apr. 9, 2019

(54) NUTRITIONAL SUPPLEMENTS TRAVEL DISPENSER

(71) Applicant: Life Boost LLC, Northville, MI (US)

(72) Inventors: Jeffrey Thomas Linton, Ann Arbor, MI (US); Chase Ryan Linton, Ann Arbor, MI (US); Ted Matthew Mills, Novi, MI (US)

(73) Assignee: Life Boost Inc., Plymouth, MI (US)

( * ) Notice: Subject to any disclaimer, the term of this patent is extended or adjusted under 35 U.S.C. 154(b) by 0 days.

(21) Appl. No.: 15/546,517

(22) PCT Filed: Feb. 4, 2016

(86) PCT No.: PCT/US2016/016499
§ 371 (c)(1),
(2) Date: Jul. 26, 2017

(87) PCT Pub. No.: WO2016/126904
PCT Pub. Date: Aug. 11, 2016

(65) Prior Publication Data

US 2018/0022518 A1 Jan. 25, 2018

Related U.S. Application Data

(60) Provisional application No. 62/113,416, filed on Feb. 7, 2015.

(51) Int. Cl.
*B65D 51/22* (2006.01)
*B65D 77/24* (2006.01)
(Continued)

(52) U.S. Cl.
CPC ..... *B65D 51/222* (2013.01); *B65D 43/163* (2013.01); *B65D 43/22* (2013.01);
(Continued)

(58) Field of Classification Search
CPC .. A47J 31/40; A47J 31/401; A61J 1/03; A61J 1/035; A61J 3/00; A61J 3/002;
(Continued)

(56) References Cited

U.S. PATENT DOCUMENTS 5,762,199 A 6/1998 Aguilera
5,799,821 A 9/1998 Lambelet et al.
(Continued)

FOREIGN PATENT DOCUMENTS

WO 2004069688 A3 2/2005

*Primary Examiner* — Bryon Gehman
(74) *Attorney, Agent, or Firm* — Endurance Law Group PLC

(57) ABSTRACT

An indexable dispenser extracts single-serving doses from a multi-serving supplements cartridge for delivery as a drinkable solution. The indexable dispenser includes a lance that punctures one serving chamber at a time so that its granulated contents can be drained into a mixing cup. The lance is attached to a rotatable flap, along with a spur. The spur punctures a membrane covering a marker zone when the flap is closed to enable machine readability. The granulated supplements are mixed with water before consumption. The indexable dispenser is configured with a dispensing window to reveal only one serving chamber at a time. The supplements cartridge is manually positioned so that an unopened serving chamber is presented in the dispensing window each time for extracting its supplements. The mixing cup may be collapsible, and together with a cap, stored in a cavity of the supplements cartridge for travel.

20 Claims, 11 Drawing Sheets

(51) Int. Cl.

| | |
|---|---|
| ***B65D 83/06*** | (2006.01) |
| ***B65D 43/16*** | (2006.01) |
| ***B65D 43/22*** | (2006.01) |
| ***B65D 77/20*** | (2006.01) |
| ***B65D 77/40*** | (2006.01) |

(52) U.S. Cl.
CPC ..... *B65D 77/20* (2013.01); *B65D 77/24* (2013.01); *B65D 77/40* (2013.01); *B65D 83/06* (2013.01); *B65D 2251/009* (2013.01); *B65D 2251/0021* (2013.01); *B65D 2251/0028* (2013.01); *B65D 2251/0093* (2013.01)

(58) Field of Classification Search
CPC ..... B65D 25/04; B65D 25/28; B65D 43/16; B65D 43/163; B65D 43/22; B65D 51/22; B65D 51/222; B65D 77/0413; B65D 77/20; B65D 77/24; B65D 77/40; B65D 83/04; B65D 83/0454; B65D 83/06; B65D 85/804; B65D 85/8043; B65D 2251/0021; B65D 2251/0028; B65D 2251/009; B65D 2251/0093; B65D 77/04; G07F 11/66–11/72
USPC ..... 206/531–533, 538, 539; 221/25, 30, 90, 221/121
See application file for complete search history.

(56) References Cited

U.S. PATENT DOCUMENTS

| | | | | |
|---|---|---|---|---|
| 5,853,101 | A | 12/1998 | Weinstein | |
| 6,126,010 | A | 10/2000 | Kogen | |
| 6,364,155 | B1 | 4/2002 | Wolfe | |
| 6,669,022 | B2 * | 12/2003 | Donegan | B65D 83/0454 206/531 |
| 6,805,258 | B2 * | 10/2004 | Cross | B65D 83/0463 221/25 |
| 6,874,652 | B2 * | 4/2005 | Christensen | B65D 83/0454 221/30 |
| 7,377,277 | B2 * | 5/2008 | Hickey | B65D 83/06 128/203.15 |
| 2002/0048621 | A1 | 4/2002 | Boyd et al. | |
| 2002/0166791 | A1 | 11/2002 | Donegan | |
| 2004/0188313 | A1 | 9/2004 | Tedham | |
| 2004/0197444 | A1 | 10/2004 | Halliday et al. | |
| 2009/0078606 | A1 | 3/2009 | Conley et al. | |
| 2014/0130678 | A1 | 5/2014 | Frydman | |
| 2016/0280454 | A1 * | 9/2016 | Mills | B65D 25/28 |

* cited by examiner

NUTRITIONAL SUPPLEMENTS TRAVEL DISPENSER

CROSS REFERENCE TO RELATED APPLICATIONS

This application claims priority to Provisional Patent Application No. 62/113,416 filed Feb. 7, 2015, the entire disclosure of which is hereby incorporated by reference and relied upon.

BACKGROUND OF THE INVENTION

Field of the Invention

The invention relates generally to a system and method for the delivery of powder-form dietary supplements and/or pharmaceuticals in measured doses to be mixed with liquid and consumed by drinking.

Description of Related Art

A dietary supplement provides a person (or animal) with nutrients that may otherwise not normally consume in sufficient quantities. As used herein, the term dietary supplement and nutritional supplement are used more or less interchangeably and are intended to broadly define any and all types of vitamins, minerals, fibers, fatty acids, proteins, amino acids, herbal medicines, bodybuilding supplements, pharmaceuticals, therapeutics, medicines, drugs, treatments and any other like substance that is ingested for useful purposes. It has been reported that more than half of the U.S. adult population regularly consumes non-pharmaceutical dietary supplements, with the most common type being multi-vitamins. When considering also medicinal forms of dietary supplements, the number is substantially higher.

The traditional market for the manufacture and intake of dietary supplements are most often produced in a tablet or capsule form. Pills and capsules are difficult for many people to swallow and/or digest. Manufacturing of such dietary supplements in pill/tablet form requires the use of fillers and/or binding agents in order to produce a tablet that is solid and has an acceptable shelf life. Manufactured tablets or capsules are often large which tends to limit the amount of active ingredient content. Many consumers will avoid or are unable to take large pills, which leaves the consumer with few attractive alternatives.

The dietary supplement industry has tried to address this issue by providing rapidly dissolving tablets and chewable tablets. Dietary supplements in dissolving tablet or chewable form have many of the same negative attributes of capsules and tablets, such as they typically contain fillers, sugars or binding agents which limit the amount of active ingredient content. The excessive use of fillers and binding agents resists digestion in the human (or animal) body; numerous studies have concluded that pill-form vitamins with even moderate amounts of fillers and/or binding agents can pass through the human digestive system with only a fraction of the active ingredients having been absorbed in the body. Gel-type tablets have been developed to help address the absorption issues, but tend to be even larger and more difficult to swallow especially for those who suffer with esophageal dysphagia.

Swallowing large pills, and even small pills for some, are difficult for many people. Those who are elderly, those with throat conditions, and children typically experience the most discomfort ingesting pill/tablet form dietary supplements. And in addition to humans, many conscientious pet owners would like to provide dietary supplements to their dog or cat or horse or other valued animal. Some pets will resist taking a dietary supplement in pill-form, regardless of pill size. And some animals have a more rapid digestive through-put than humans, making pills with substantial amounts of fillers and binding agents even less effective by passing through the animal's body before a sufficient load of the active ingredients having been absorbed.

Another issue with prior art dietary supplements relates to correct dosing. As many dietary supplements are sold "over-the-counter", many consumers will form a subconscious understanding that the dietary supplements do not need to be taken with the same high level of care as they might otherwise give to prescription medicines. As an effect of this subconscious belief, the average consumer may not be as concerned about missing a daily dose, or perhaps at the other extreme of taking two doses when only one is recommended. For example, a busy or distracted person might not recall if they had taken their vitamin pill that day. This person might think "No big deal, I will take one tomorrow". Or they might think, "No big deal, I will take another pill just to be safe". In both cases, the person runs the risk of either over-dosing or under-dosing their intake of the dietary supplement. Of course, pills boxes and the like have been developed to help organize pill consumption for people, but such are normally used for prescription medicines only and require a high degree of discipline to use regularly.

There is therefore a need in the art for an improved dietary supplement system that reduces the use of fillers and binding agents, and that reduces the likelihood of over-dosing and under-dosing, and that is easily swallowed, and that is rapidly digested. Furthermore, there is a need for a dispensing device that is travel friendly.

BRIEF SUMMARY OF THE INVENTION

According to a first aspect of this invention. A granulated nutritional supplement dispensing assembly is provided. The assembly comprises a supplements cartridge and a manually indexable dispenser. The supplements cartridge has a generally annular frame centered about a central axis. The frame includes a plurality of serving chambers. A volume of granulated nutritional supplement is sealed in each serving chamber. Each serving chambers includes a fracturable element configured to be forcefully ruptured in order to extract the volume of granulated nutritional supplement therefrom. A plurality of marker zones are spaced apart from the serving chambers, each marker zone being associated with a different serving chamber. The marker zones are configured to be physically altered with the forceful rupturing of the fracturable element. The manually indexable dispenser is coupled to the supplements cartridge, and is operative to open the serving chambers one-at-a-time to empty the granulated nutritional supplement therefrom.

According to a second aspect of this invention, a manually indexable dispenser if provided. The indexable dispenser is of the type which is coupled to an annular nutritional supplements cartridge having a plurality of serving chambers each sealed by a membrane to store a volume of granulated nutritional supplement. The indexable dispenser comprises a generally annular cover. The cover has an outer rim that is adapted to at least partially encircle the supplements cartridge. The cover includes a dispensing window that is shaped and dimensioned to expose a select one of the serving chambers in the supplements cartridge while the adjacent serving chambers remain hidden behind the cover. A flap is supported on the cover for movement between an open position exposing the dispensing window and a closed position covering the dispensing window. The flap has a lance configured to breach the membrane in a region overlaying a select one of the serving chambers of the supplements cartridge. The flap further includes a spur. The spur is configured to puncture the membrane in a region overlaying one of the marker chambers.

The present invention provides an improved dietary supplement system that facilitates use of easily swallowed, rapidly digested nutritional supplements in granulated form. A travel-friendly indexable dispenser reduces the likelihood of a user over-dosing or under-dosing themselves or the person/animal to whom they are rendering health care assistance.

BRIEF DESCRIPTION OF THE SEVERAL VIEWS OF THE DRAWINGS

These and other features and advantages of the present invention will become more readily appreciated when considered in connection with the following detailed description and appended drawings, wherein.

DETAILED DESCRIPTION OF THE INVENTION

Figure 1:
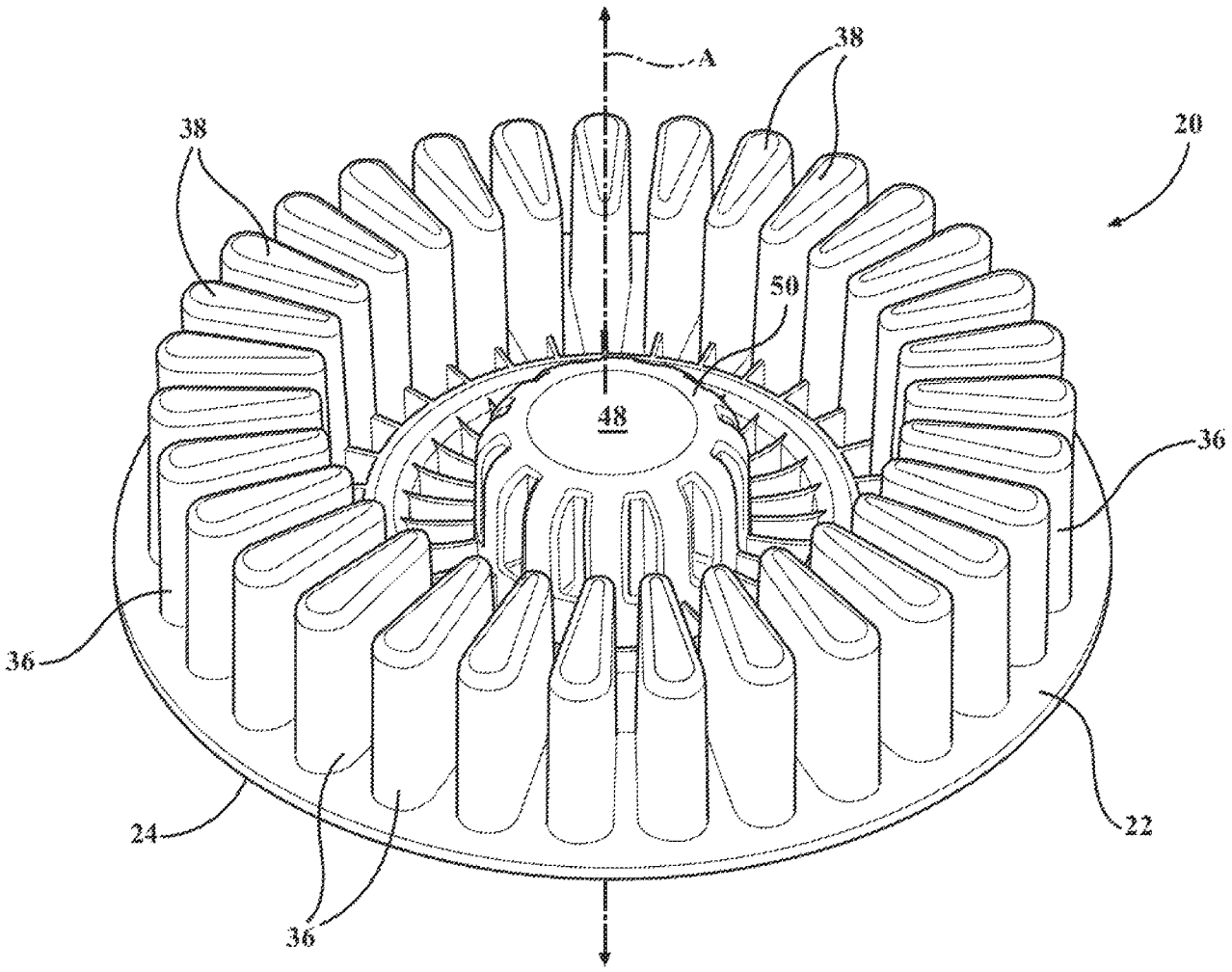
FIG. 1 is a perspective view of a supplements cartridge according to one embodiment of the invention.

This present application advances the teachings in the Applicant's prior published patent application WO 2015/073402, published May 21, 2015, the entire disclosure of which is hereby incorporated by reference and relied upon in all permitted jurisdictions.

An exemplary supplements cartridge is generally indicated at 20 throughout the figures. The supplements cartridge 20 contains a plurality of doses of a nutritional supplement S (FIG. 5), wherein the nutritional supplement S may be of any type and for any purpose that is ingested or applied to a person or animal or other living thing, including but not limited to granulated pharmaceutical compounds. As used herein, the term dietary supplement and nutritional supplement are used more or less interchangeably and are intended to broadly define any and all types of vitamins, minerals, fibers, fatty acids, proteins, amino acids, herbal medicines, bodybuilding supplements, pharmaceuticals, therapeutics, medicines, drugs, treatments and any other like substance that is ingested or absorbed or otherwise received by the recipient. The present invention provides a device and methods for dispensing nutritional supplements S that will mix powder-form dietary supplements in measured doses with water or other suitable suspension liquid to be subsequently consumed by drinking or the like. The invention enables users to supplement their dietary needs or take medicinal substances in an easy to use and efficient manner with high quality and pure form active ingredients. Health maintenance regimens enabled by this invention can be responsibly delivered to children, adults, the elderly, people who experience difficulty taking pills and tablets, as well as for pets, plants and other suitable life forms for any and all purposes.

Most commonly, the user extracts one dose from the supplements cartridge 20 each day or other specified interval period. However, depending on the specific nutritional supplement S contained in the supplements cartridge 20, more or less than one dose may be indicated each day or other time interval. In the example of a multi-vitamin type of nutritional supplement where the user is a nominally healthy adult, the recommended dosage may be one dose extracted from the supplements cartridge 20 each day. In the example of a body-building type of nutritional supplement where the user is a competitive athlete, the recommended dosage may be multiple doses extracted from the supplements cartridge 20 each day. The supplements cartridge 20 may take any of various forms suitable to hold and dispense individual doses of a given granular or powder nutritional supplement, including the form of a strip, a drum, a matrix, a blister pack, a loose container or hopper, or the like. In the portrayed examples, however, the supplements cartridge 20 takes a rotary form, having an annular frame 22 centered about a central axis A.

FIGS. 1-5 best illustrate the exemplary rotary style supplements cartridge 20 in one preferred configuration, but by no means the only possible configuration. Again, it is to be emphasized that the supplements cartridge 20 could be reconfigured in any of several non-rotary styles mentioned above. In the preferred rotary configuration, however, the frame 22 of the supplements cartridge 20 is a generally flat or sheet-like annulus having an outer peripheral flange 24 about its exterior and an interior hole 26 centered about the central axis A. The annular body of the frame 22 between its outer peripheral flange 24 and interior hole 26 can be beneficially considered according to several annular bands or regions. An outermost annular region 28 occupies the band closest to or adjacent the peripheral flange 24. Like its outer bordering peripheral flange 24, the outermost annular region 28 is also centered about the central axis A. An innermost annular region 30 occupies the band closest to or adjacent the adjacent the interior hole 26, and is also centered about the central axis A. The body of the frame 22 further includes an intermediate annular region 32 that is disposed between the outermost 28 and the innermost 30 annual regions. The regions 28, 30 and 32 are clearly labeled in FIGS. 3-5.

A plurality of chamber openings 34 are arranged in the outermost annular region 28 of the frame 22. That is to say, in the annular band or region 28 of the frame 22 that is proximate to the outer peripheral flange 24, an array of chamber openings 34 are located. The chamber openings 34 are arranged, preferably, in equal radial and circumferential increments about the central axis A within the outermost annular region 28. In other words, the chamber openings may be neatly set in a circular pattern around the frame 22 within its outermost annular region 28. The exact number of chamber openings 34 may vary depending on the nature of nutritional supplement S to be dispensed, intended application, and other factors. In one contemplated embodiment, the number of chamber openings 34 will be selected as a whole number multiple of an overall coverage period for the supplements cartridge 20. That is, the coverage period is the period of time the supplements cartridge can be used by a user to deliver the recommended number of doses. As examples, the coverage period for a given supplements cartridge 20 could be one week, two weeks, four weeks or one month. Other coverage periods are certainly possible. In the example of a one-month coverage period where one dispensed dose per day is recommended, the number of chamber openings 34 could be selected at thirty or thirty-one. Alternatively, if two doses per day are recommended and the coverage period is two weeks, the supplements cartridge 20 may be configured with twenty-eight (two times fourteen) chamber openings 34. In yet another example, if three doses per day are recommended and the coverage period is one week, the supplements cartridge 20 may be configured with twenty-one (three times seven) chamber openings 34. While a wide range of the number of chamber openings 34 is possible, in the preferred embodiments the number of chamber openings 34 will be between twenty-eight and thirty-one.

Figure 2:
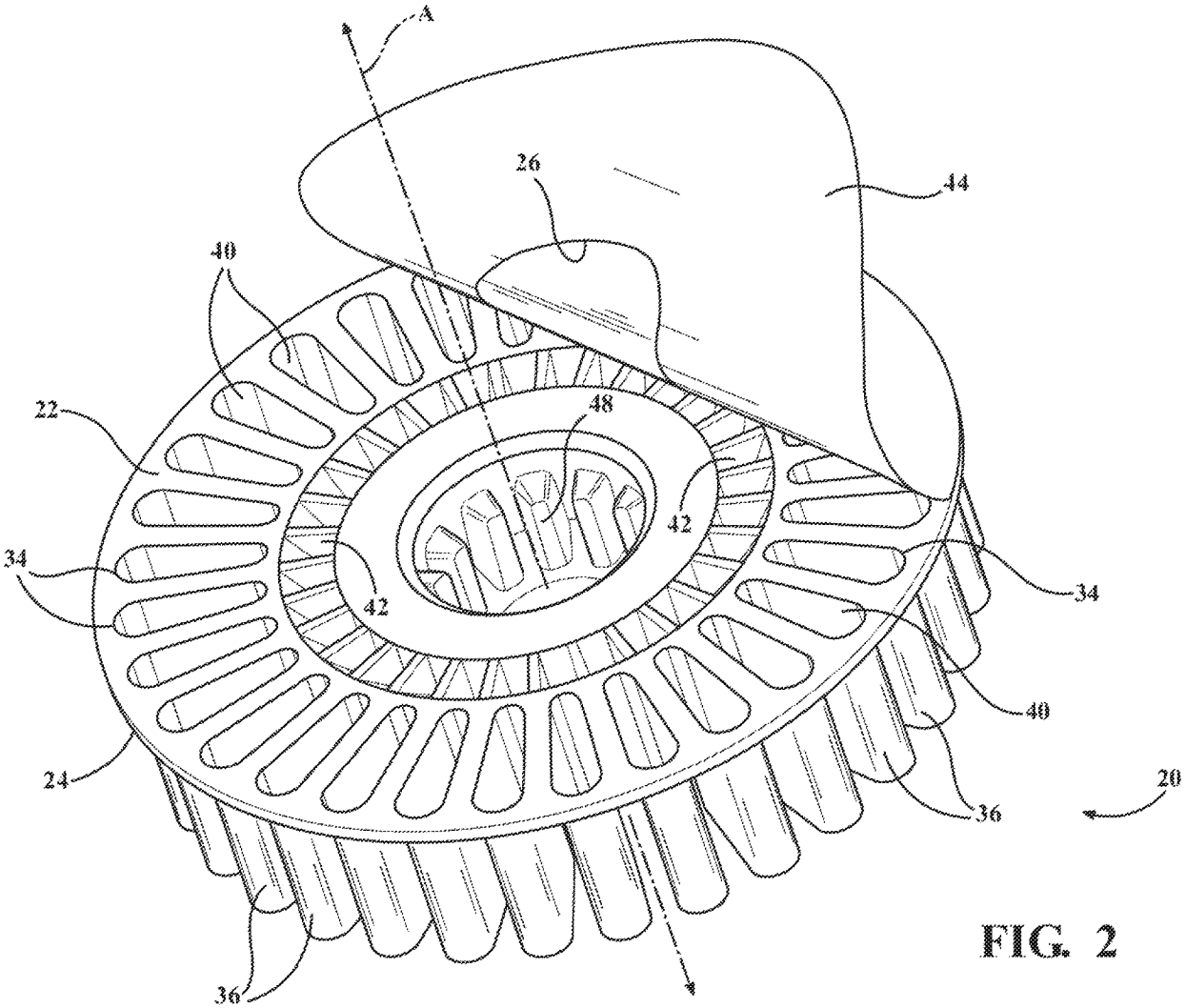
FIG. 2 is an inverted perspective view of the supplements cartridge in FIG. 1, and illustrating the membrane partially peeled away to expose an annular array of serving chambers and associated marker cavities.
Figure 4:
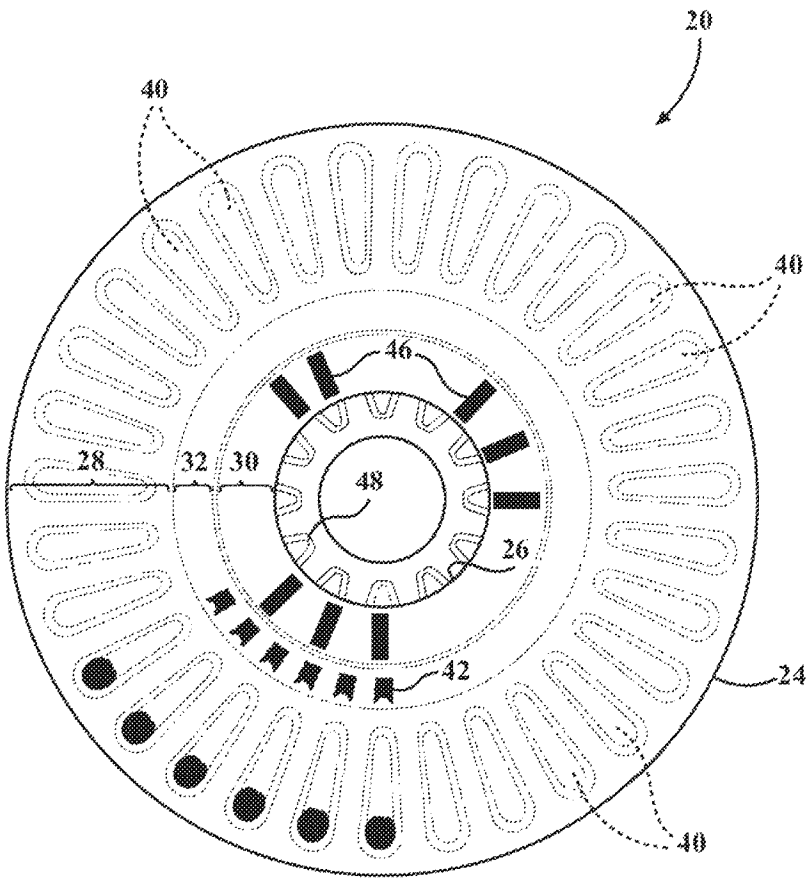
FIG. 4 is a view as in FIG. 3 but where the exemplary supplements cartridge has previously had six serving chambers opened and their associated marker cavities ruptured.
Figure 3:
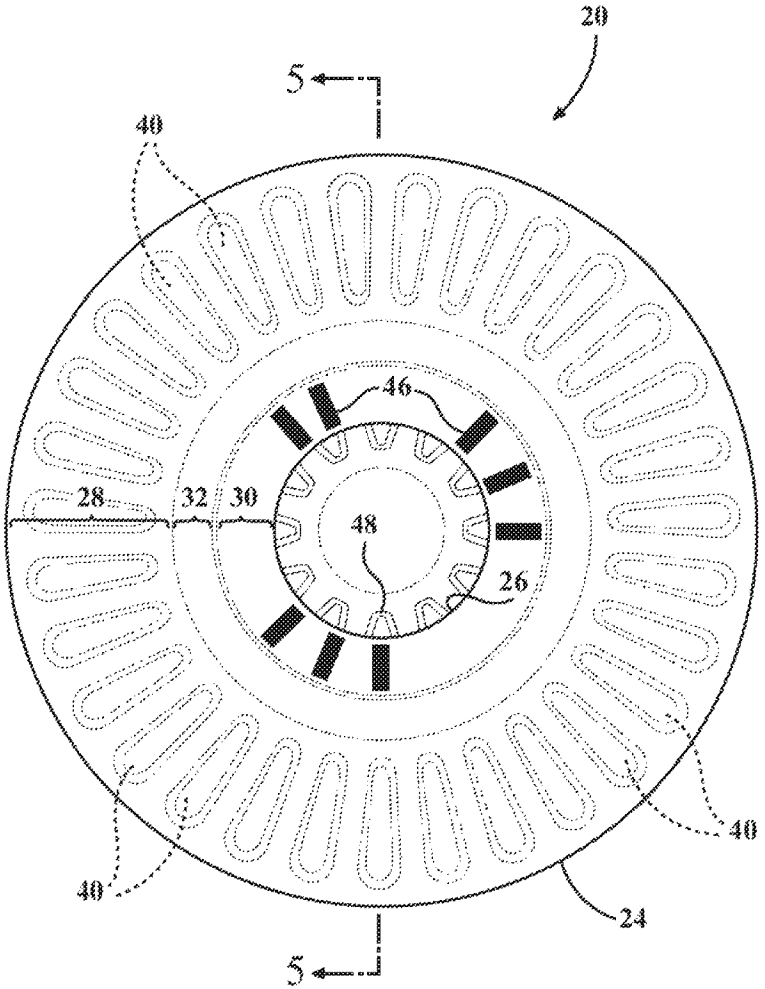
FIG. 3 is a bottom view of an unused exemplary supplements cartridge showing the membrane without any puncture marks.

As best shown in FIGS. 2-4, each chamber opening 34 has a radially widening, i.e., wedge-like, shape to maximize use of the outermost annular region 28 into which they are placed. The radially widening wedge shape is narrowest adjacent the intermediate annular region 32 and widest adjacent the peripheral flange 24. Sidewalls 36 surround each chamber opening 34 and extending generally perpendicularly from the frame 22. The sidewalls 36 for each respective chamber opening 34 are covered by a closed end 38 to form a serving chamber 40 behind each chamber opening 34. The dry granulated or powdered nutritional supplement S is disposed in each serving chamber 40, and typically comprises one measured dose. Therefore, the number of serving chambers 40 in the supplements cartridge 20 corresponds to the number of doses or servings that supplements cartridge 20 is able to deliver. For example, thirty-one doses can be extracted from a supplements cartridge 20 that has thirty-one serving chambers 40. Twenty-eight doses can be extracted from a supplements cartridge 20 that has twenty-eight serving chambers 40. And so forth.

In the preferred embodiment, a generally equal volume and composition of granulated nutritional supplement S is disposed in each serving chamber 40. However, it is contemplated that in some applications it may be desirable to place an unequal volume and/or composition of nutritional supplement S in the serving chambers 40. As one example of the latter statement, consider a situation where one dose per day is recommended of three separate nutritional supplements S. A supplements cartridge 20 may be fashioned in which its coverage period is one week and it is configured with twenty-one serving chambers 40. In this case, every third serving chamber 40 can be filled with the first nutritional supplement, the next adjacent serving chambers 40 filled with the second nutritional supplement, and the remaining serving chambers 40 filled with the third nutritional supplement. Once daily over the course of one week, the user extracts nutrition supplements from three sequential serving chambers 40 and thereby receives one dose per day of the three separate nutritional supplements S. In another example, there may be cases where a nutritional supplement is a blend of several components, and certain specific components to not mix well with other specific components. In these instances, a single dose comprises the combination of the two non-mixing agents. It may be desired to place the non-mixable components in separate (usually adjacent) serving chambers 40 to be extracted and mixed only at a moment just prior to consumption.

Figure 5:
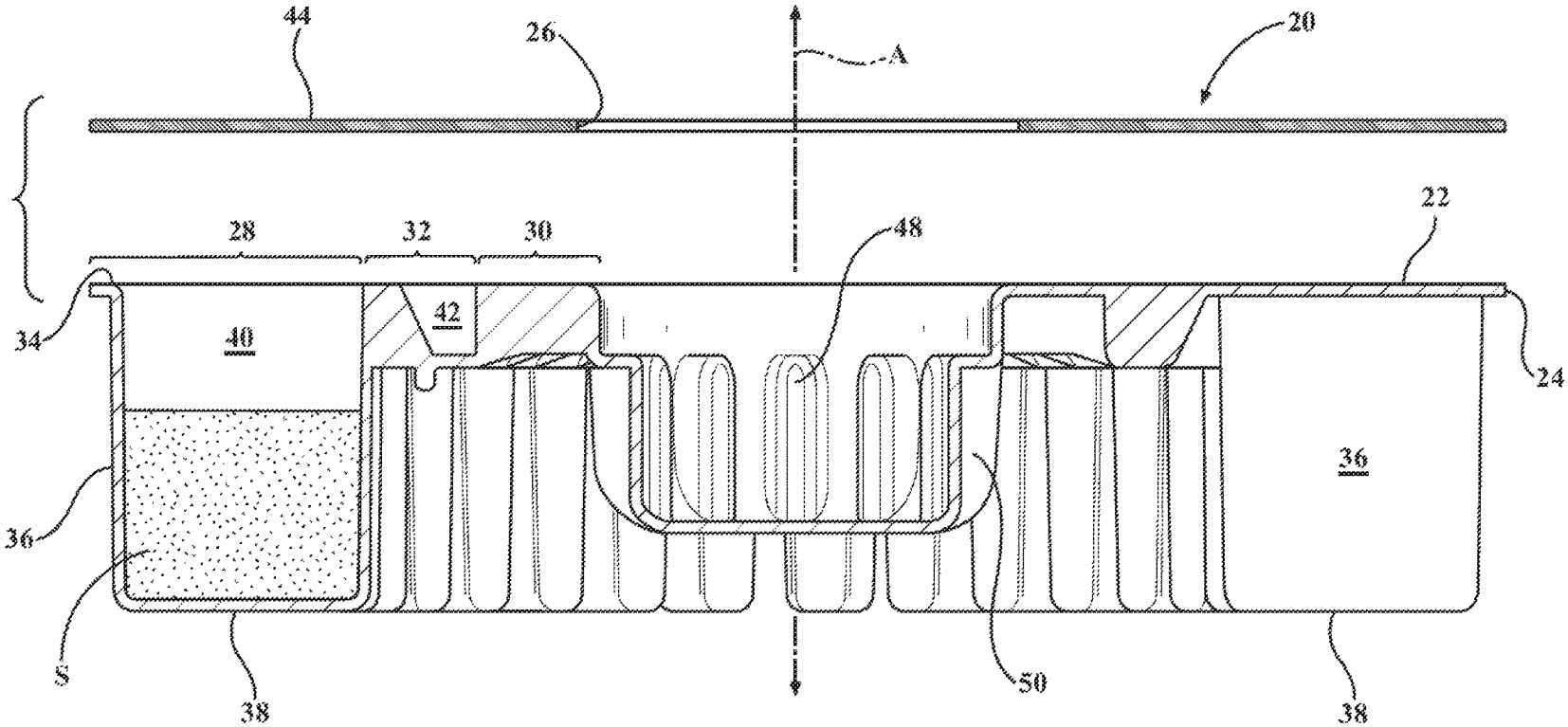
FIG. 5 is a longitudinal cross-section taken generally along lines 5-5 of FIG. 3, and showing the membrane exploded away.

Referring still to FIGS. 2-4 and also now FIG. 5, each serving chamber 40 is preferably associated with a marker zone 42. If the supplements cartridge 20 is configured with thirty serving chambers 40, then there are preferably also thirty marker zones 42. The ratio is preferably 1:1; one marker zone 42 for each serving chamber 40 regardless of the number of serving chambers 40. The marker zones 42 may take any suitable form, with some alternative examples given below. In the illustrated embodiment, however, the marker zones 42 are located exclusively in the intermediate annular region 32. Like the chamber openings 34, the marker zones 42 are also preferably arranged in equal radial and circumferential increments about the central axis A within the intermediate annular region 32. And also likewise, the plurality of marker zones 42 correspond in number to the plurality of chamber openings 34, with each marker zone 42 being radially aligned with a respective one of the chamber openings 34. Each marker zone 42 is defined by a marker cavity, which is located directly behind each marker zone 42 in the form of a well of cup-like formation. The marker zones 42 are preferably spaced apart from the serving chambers 40 for reasons that will be more fully explained below. Also as will be described more fully below, the marker zones 42 are configured to be physically altered or even mutilated as a means of keeping track of which serving chambers 40 have been opened and which remain full of un-extracted nutritional supplement.

Each serving chamber 40 is provided with a fracturable element of some kind that is configured to be forcefully ruptured in order to extract the volume of granulated nutritional supplement S contained therein. It is contemplated that the fracturable element could take any of various forms, including a stress-concentrating breakage line in the sidewalls 36 of each serving chamber 40, a tear-open paper section, or perhaps a peel-away seal covering each chamber opening 34. Many other possibilities exist. In the illustrated examples, the fracturable element comprises a punctureable membrane 44 that is disposed in surface-to-surface relationship over the flat face of the frame 22 so that the chamber openings 34 and the marker zones 42 are sealed closed. An adhesive (not shown) can be applied to the frame 22 to create a hermetic seal for each serving chamber 40. Nutritional supplements S stored in each serving chamber 40 will be safely (i.e., medically) sealed by the glued-on membrane 44 so that the trapped supplements remain clean and sterile with a long shelf life. The membrane 44 preferably has an inner hole aligned with the interior hole 26 of the frame 22.

The membrane 44 is fractured over a given chamber opening 34 to extract the nutritional supplements S from the underlying serving chamber 40. Concurrently therewith, the membrane 44 is also ruptured over the corresponding marker zone 42 to indicate that its associated serving chamber 40 has been opened. By "concurrently," it is meant to broadly define a sequence of events that happened generally close in time if not simultaneously. For example, the membrane 44 may be ruptured over a particular serving chamber 40 and then shortly thereafter the membrane 44 over the corresponding marker zone 42 is ruptured. Or, the membrane 44 over a marker zone 42 could be punctured and shortly thereafter the associated serving chamber 40 is opened. Or, the membrane 44 covering the serving chamber 40 could be ruptured simultaneously with the corresponding marker zone 42 being punched through. In this manner, the marker zones 42 are configured to be physically altered by puncturing the membrane 44 covering into the respective marker cavities at about the same time with the associated serving chambers 40.

The membrane 44 may comprise a foil-like material, a plastic material, a paper-based material, or any other suitable composition. Most preferably, the portion of the membrane 44 overlying the intermediate 32 and innermost 30 regions has an outer reflective surface or other reflective properties capable of reflecting a beam of light (within a selected range of wavelengths along the light spectrum). White and silver are two good color choices for the outer reflective surface of the membrane 44. FIG. 3 shows the membrane 44 of an unused supplements cartridge 20. Serving chambers 40 and marker zones 42 below the membrane 44 are indicated by hidden lines. FIG. 4 shows the same supplements cartridge 20 as in FIG. 3, but after six doses have been extracted. In particular, the six contiguous serving chambers 40 between the six o'clock and eight o'clock positions have been opened as will be apparent by the corresponding breaches in the membrane 44 through which the powdered nutritional supplements S have been extracted. Marker zones 42 associated with each of the six opened serving chambers 40 are also shown as having been punctured. Hence, it will be seen by comparison of FIGS. 3 and 4 that the membrane 44 is ruptured both over a chamber opening 34 and over its corresponding marker zone 42 to indicate that the associated serving chamber 40 has been opened.

In alternative contemplated configurations, some other action altogether may be taken to identify a used marker zone 42. This may include a simple ink dabbing on the membrane 44, a notch of frame 22 material removed from the peripheral flange 24, or any other marking action that fulfills the objective of keeping track of which serving chambers 40 have been opened and which remain full of un-extracted nutritional supplement. And preferably, the marker zones 42 are spaced apart from the serving chambers 40, however in some contemplated embodiments the marker zones could be integrated with the fracturable element of the serving chambers 40 so that the serving chamber 40 per se is used to identify whether it has been previously opened or not.

Optionally, the supplements cartridge 20 may include binary code indicia 46 imprinted on, or otherwise appearing on, the membrane 44. Binary code indicia 46, in the form of bar codes in the illustrated examples, are placed so as to reside within the innermost annular region 30 of the frame 22, as shown in FIGS. 3 and 4. The binary code indicia 46, when used, are preferably machine-readable and associated with a look-up table or other reference data that may be used to identify important details about the supplements cartridge 20, including its coverage period, recommended dosing, intended uses, mixing instructions, etc. At least one starter queue indicia appears on the membrane 44, or is otherwise associated with the supplements cartridge 20, to provide a reference for an automated dispensing machine (not shown) to accurately open a first serving chamber 40 in a brand new, previously unused supplements cartridge 20. That is, without any previously opened serving chambers 40, the starter queue indicia guide a suitably configured dispensing machine to align with one of the serving chambers 40 that will be first opened. The starter queue indicia shown in FIGS. 3 and 4 is integrated with the binary code indicia 46, such that the placement of the bar code markings will allow a suitable dispensing machine to radially align itself with a select one of the serving chambers 40. In alternative embodiments, not shown, the starter queue indicia could comprise a machine-readable marking disposed on the membrane 44 adjacent the peripheral flange 24 or in some other location of the supplements cartridge 20. A dispensing machine capable of utilizing the starter queue indicia/binary code indicia 46 in this manner is shown, for example, in the aforementioned published patent application WO 2015/073402.

Still considering the supplements cartridge 20, a spline cup 48 may be affixed to the frame 22, generally centered over the interior hole 26. The spline cup 48 includes a plurality of axially extending female splines, as shown in FIG. 2. The female splines in the spline cup 48 are thus accessible through the interior hole 26. An outer surface 50 of the spline cup 48 is preferably configured as a graspable handle. See, for examples, FIGS. 1 and 11 where the outer surface of the spline cup 48 is visible as a knob-like element that can be easily grasped with the human hand when manipulating the supplements cartridge 20. A generous space between the outer surface 50 and the sidewalls 36 of the serving chambers 40 provides ample clearance for a user's finger tips when grasping the knob-like spline cup 48.

A manually indexable dispenser, generally indicated at 52 in FIGS. 6-10, is coupled to the supplements cartridge 20 and operative to open the serving chambers 40 one-at-a-time to empty the granulated nutritional supplement S therefrom. The indexable dispenser 52 can take many different forms. In the illustrated examples, the indexable dispenser 52 comprises a cap-like or lid-like cover 54 overlying at least a plurality of the serving chambers 40. The cover 54 is generally annular and adapted to rotate about the central axis A with respect to the underlying supplements cartridge 20. That is to say, the cover 54 can revolve around the circular body of the supplements cartridge 20, indexing from one serving chamber 40 to the next, as needed, to dispense the granulated nutritional supplements S according to the user's dosing needs. The indexable dispenser 52 provides a low-cost, travel-friendly, potentially non-electric alternative to the aforementioned automated dispensing machine described in published patent application WO 2015/073402. The reference to "potentially" non-electric intends only to emphasize that electric functionality in some capacity remains an option in this present invention. Some examples of electric functionality are described below in connection with contemplated alternative embodiments.

Furthermore, in the illustrated exemplary embodiment, the indexable dispenser 52 is compatible with the automated dispensing machine in WO 2015/073402, in that a user may take some doses from the supplements cartridge 20 with one or the other dispensing apparatus, without sacrificing functionality. To exemplify this latter advantage with a hypothetical, a user can utilize the automated dispensing machine in WO 2015/073402 to take the first three doses from a 31-cell supplements cartridge 20, then remove the supplements cartridge 20 for ten days of travel using the exemplary indexable dispenser 52 take a one dose each day, and then upon returning from travel re-insert the supplements cartridge 20 into the automated dispensing machine of WO 2015/073402 and proceed to withdraw the remaining eighteen doses as needed. While the indexable dispenser 52 can be configured in many ways, the exemplary embodiment is configured to maintain seamless operability with the automated dispensing machine of WO 2015/073402 when a common supplements cartridge S is moved between the two types of dispensing apparatus.

Figure 7:
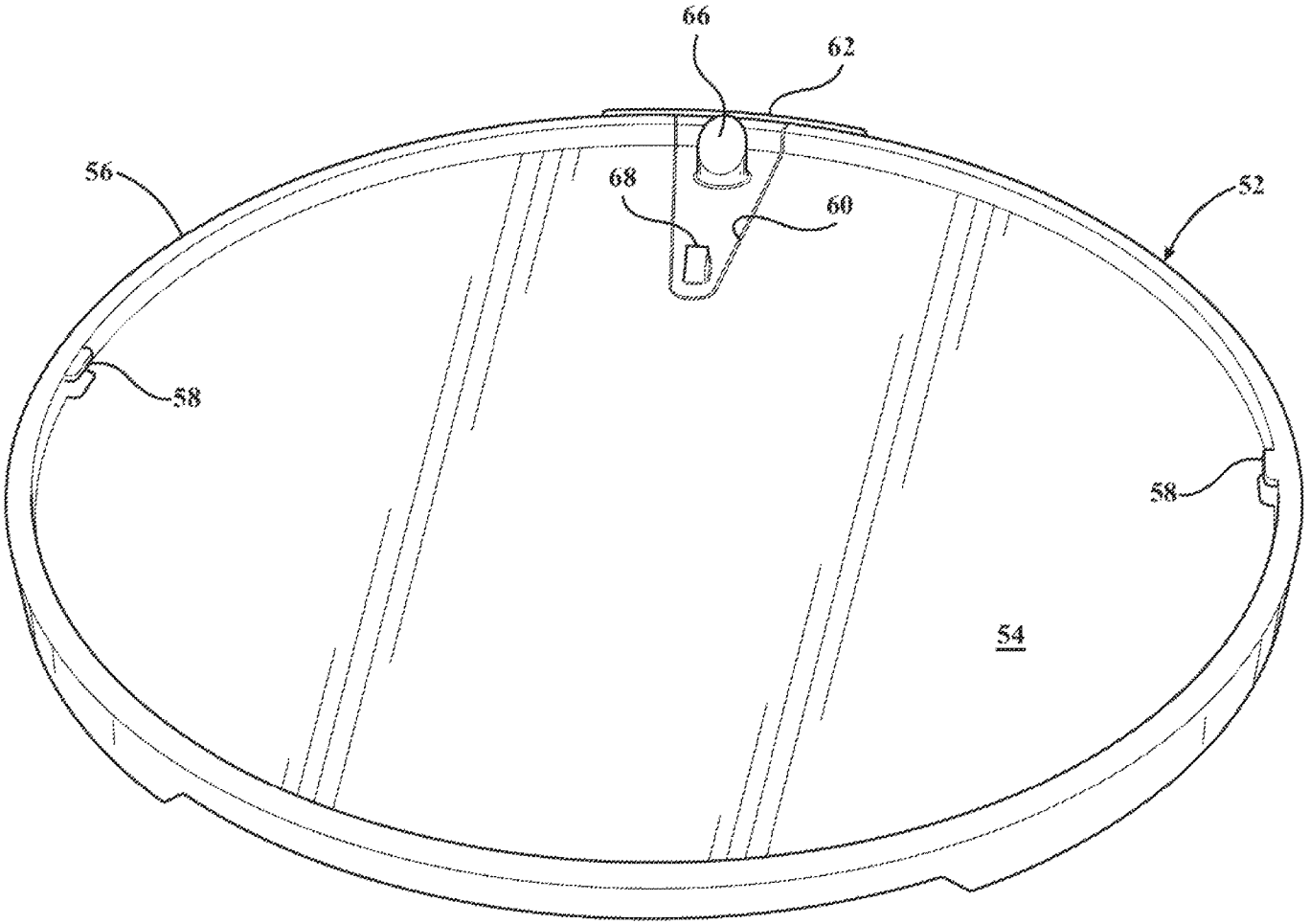
FIG. 7 is an inverted perspective view of the indexable dispenser.
Figure 8:
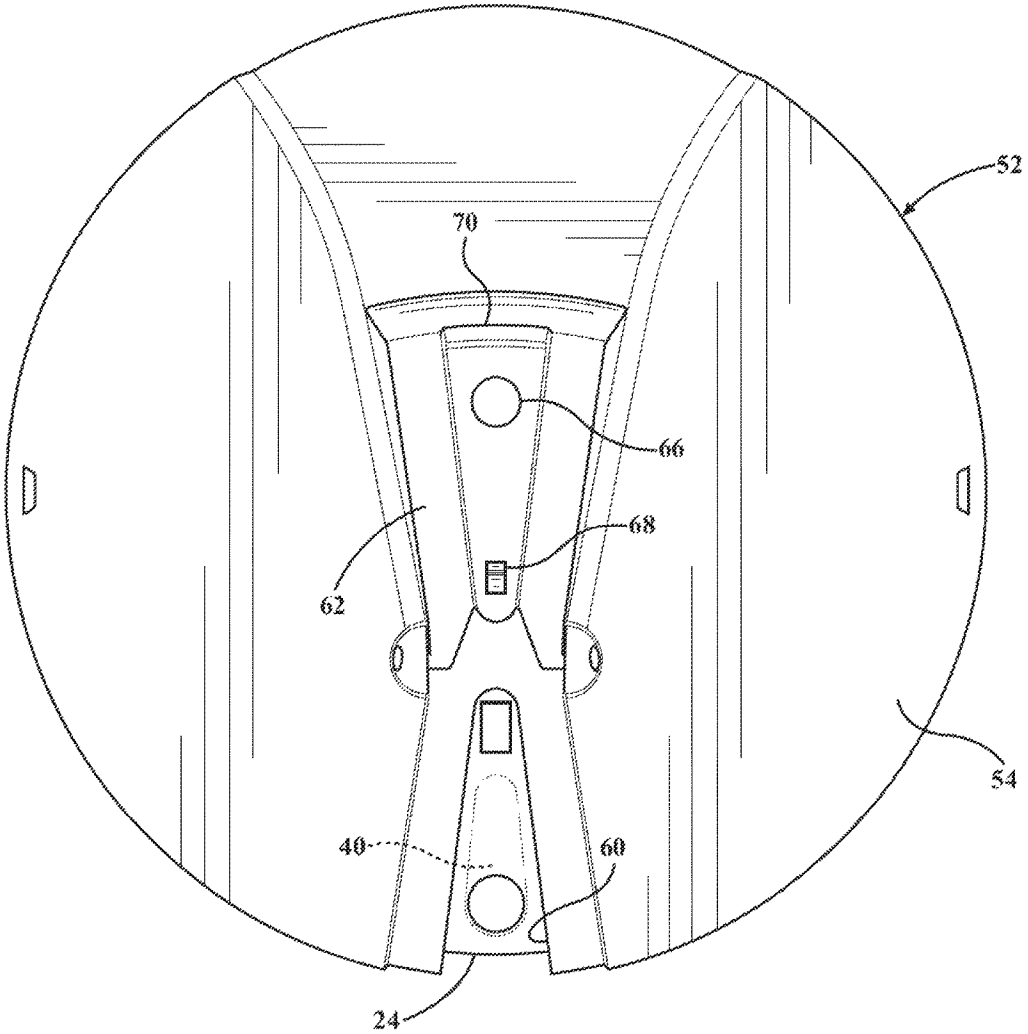
FIG. 8 is a top view of the assembled indexable dispenser and supplements cartridge, showing the flap in an open position to expose the dispensing window and through it a serving chamber in the supplements cartridge below.

The cover 54 has an outer rim 56 that at least partially encircles the peripheral flange 24 of the supplements cartridge 20. The upside-down view of FIG. 7 provides a clear view of the outer rim 56 according to one embodiment of this invention. The inside dimension of the outer rim 56 is slightly larger than the outside diameter of the peripheral flange 24, as suggested in FIG. 9. A clearance fit is established between the peripheral flange 24 and the outer rim 56 so that the cover 54 can freely rotate about the central axis A while the supplements cartridge 20 remains relatively stationary. The outer rim 56 may include some type of retention feature to hold the cover 54 in place upon the supplements cartridge 20. In the illustrated examples, retention is accomplished by at least two cleats 58 that extend inwardly from the outer rim 56, as best seen in FIG. 7. The cleats 58 are diametrically opposed, and adapted to seat behind the peripheral flange 24 in order to rotationally retain the indexable dispenser 52 to the supplements cartridge 20. Insertion and removal of the indexing dispenser 52 from the supplements cartridge 20 requires the cover 54 to be flexed so that the cleats 58 can be worked into or out of position with respect to the peripheral flange 24. Naturally, other types of retention strategies are possible, with the cleats 58 offered as but one example.

The cover 54 includes a dispensing window 60 shaped and dimensioned to expose a select one of the serving chambers 40 while the adjacent serving chambers 40 remain hidden behind the cover 54. The dispensing window 60 may have a sector shape corresponding generally to the radially widening shape of each chamber opening 34 and its associated marker zone 42. Alternatively, the dispensing window 60 could have a different shape, e.g., circular or rectangular, and even be configured with a natural spout shape to facilitate the outpouring of nutritional supplements S when a user takes a dose. As the user rotates the cover 54 over the supplements cartridge 20, the dispensing window 60 sweeps across the outermost 28 and intermediate 32 regions of the frame 22 sequentially uncovering serving chambers 40. Those serving chambers 40 which have been previously opened/emptied will be visually apparent by inspection through the dispensing window 60.

Figure 6:
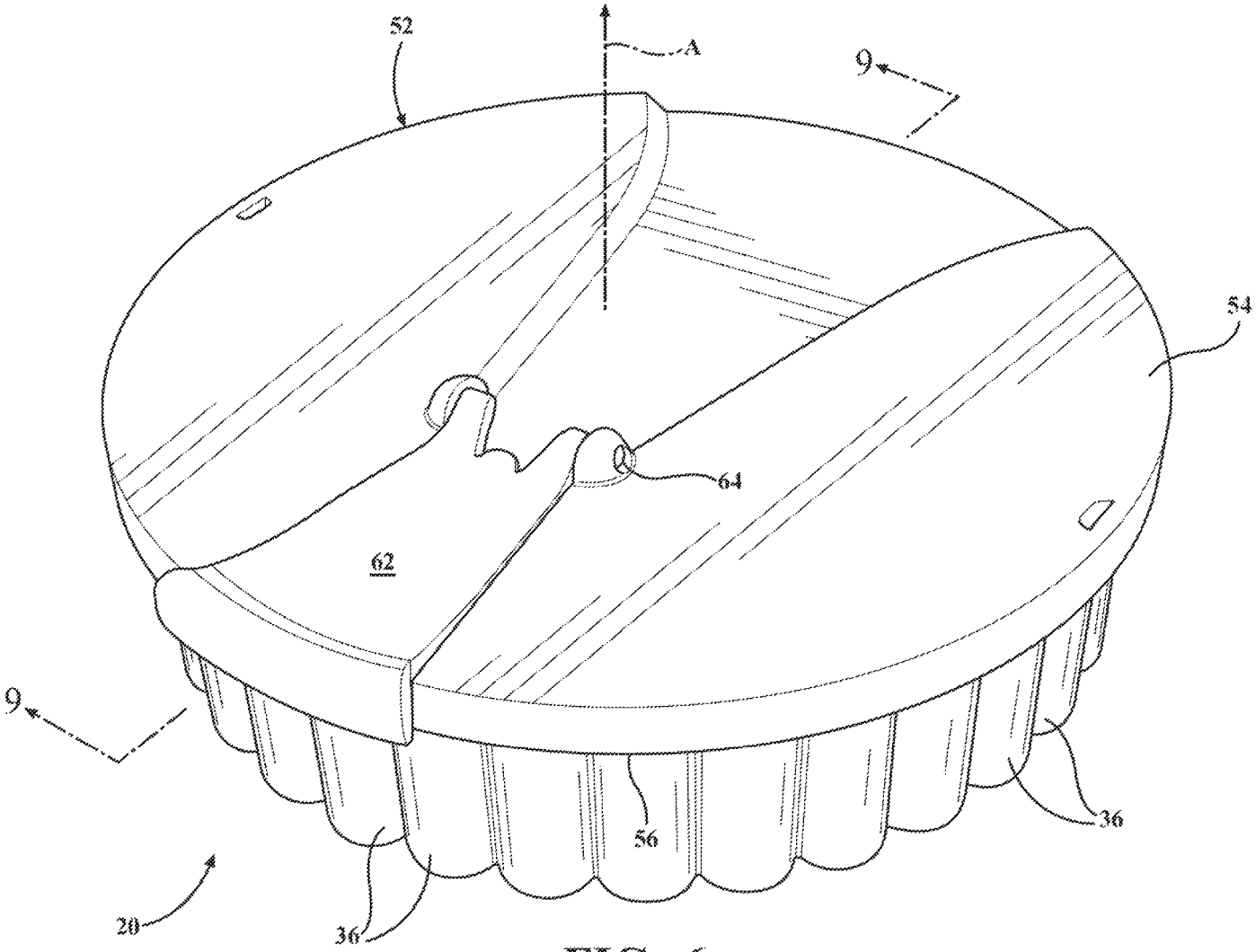
FIG. 6 is a perspective view showing an indexable dispenser according to one exemplary embodiment operatively assembled to a supplements cartridge.

In the illustrated embodiments, a flap 62 is supported on the cover 54 for movement between an open position exposing the dispensing window 60 (FIGS. 8 and 10) and a closed position covering the dispensing window 60 (FIG. 6). In the illustrated examples, the flap 62 is pivotally connected to the cover 54 via a simple hinge 64. The axis of the hinge 64 is generally parallel to a tangent at the outer edge of the dispensing window 60. Alternatively, the hinge axis could be arranged along a radial from the central axis A or along some other convenient trajectory. Other articulating connection methods for the flap 62 are certainly possible, including sliding fits, four-bar linkages, living hinges, and the like.

The inside surface of the flap 62 is provided with a lance 66 and a spur 68. The lance 66 and spur 68 correspond, generally, in function to the lance and spur features described in the aforementioned WO 2015/073402. When a user manually closes the flap 62, the lance 66 will automatically extends into a serving chamber 40 aligned within the dispensing window 60, piercing the covering membrane 44. At the same time, the spur 68 punctures the membrane 44 in the associated marker zone 42. In this manner, the lance 66 is configured to breach the membrane 44 in a region overlaying a select one of the serving chambers 40 of the supplements cartridge 20, while the spur 68 is configured to perforate the membrane 44 in a region overlaying the corresponding marker zone 42.

Figure 9:
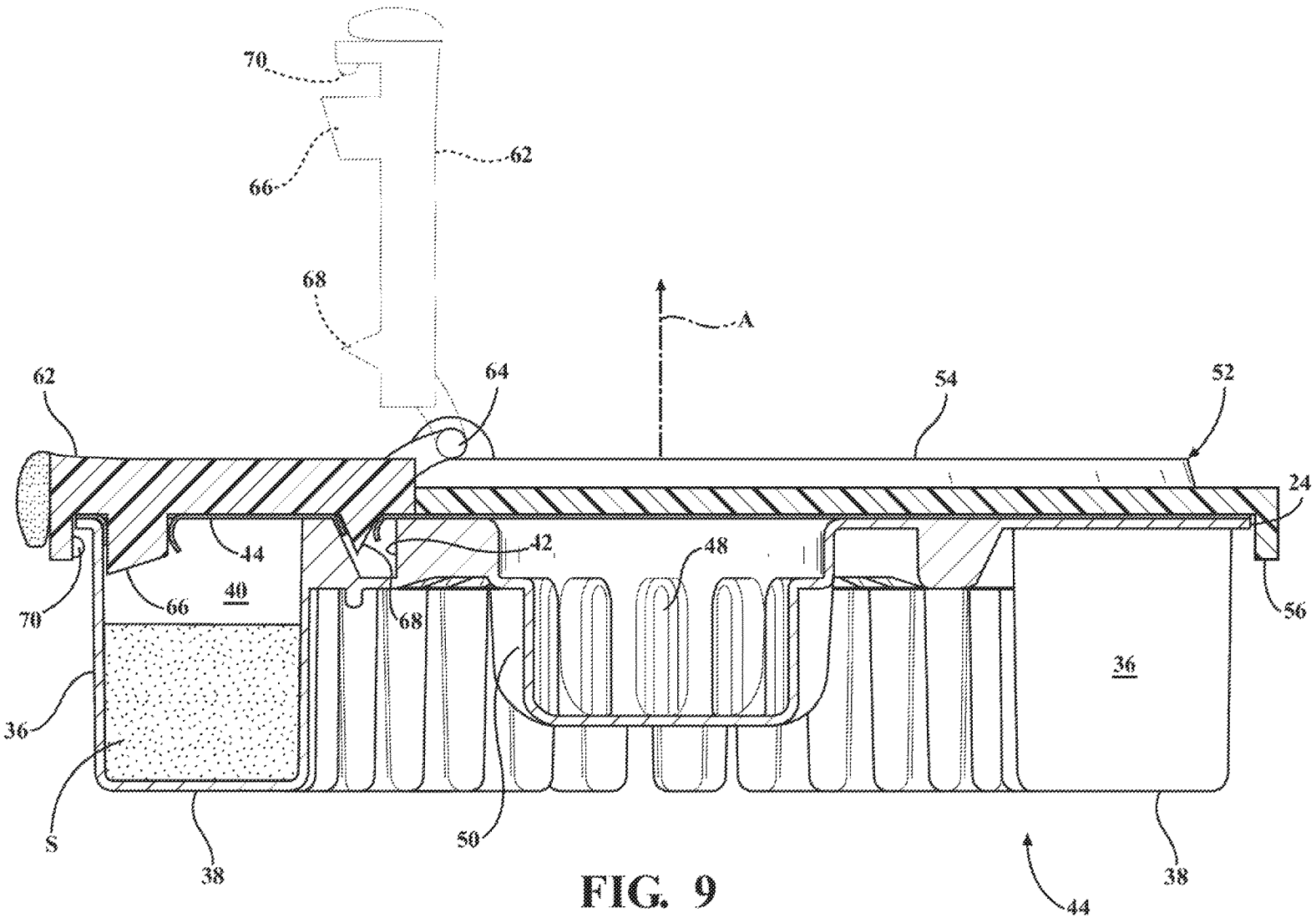
FIG. 9 is a cross-sectional view as taken generally along lines 9-9 in FIG. 6, with the flap show open in phantom lines.

A clasp 70 secures the flap 62 in the closed position covering the dispensing window 60, as shown in FIG. 9. In this closed position, the lance 66 and spur 68 create a generally complete seal over the respective punctured portions of the membrane 44, thus resisting any loss or spillage of nutritional supplements S that may be inside the serving chamber 40. That is to say, if a user assembles the indexable dispenser 52 to a new, unused supplements cartridge 20, and closes the flap 62 before placing the assembly inside a suitcase for travel, the full dose of nutritional supplements S within the affected serving chamber 40 will not spill out because the lance 66 fills and substantially seals the punctured orifice it has created in the membrane 44. Nevertheless, it may be recommended that a user avoid installing the indexable dispenser 52 onto an unused supplements cartridge 20 prior to the point in time when a dose is ready to be taken.

Upon opening the flap 62 and exposing the dispensing window 60, a user takes a dose by inverting the assembly 20, 52 and lightly agitating to transfer the powder S to a suitable mixing vessel 72. This step of emptying the contents from a serving chamber 40 is graphically depicted in FIG. 10. Springs or a catch (not shown) may be incorporated to hold the flap 62 in the open position. Water, or other suitable liquid, is combined with the nutritional supplements S in the mixing vessel 72 where they are stirred or shaken or blended into a concoction and consumed by the user or by other intended recipient. In an alternative embodiment (not shown), the mixing vessel 72 is a special-purpose device configured to couple with the dispensing window 60 and thereby perfect a secure, spill-proof connection. The coupling could be accomplished by a bayonet-style locking arrangement, screw threads, simple friction fit, or any other suitable means.

In the illustrated examples described above, the lance 66 and spur 68 are integrated into the flap 62, such that closure of the flap 62 automatically punctures the membrane 44. In other contemplated embodiments, the lance 66 and/or spur 68 may be otherwise extendable into each serving chamber 40 upon demand. In some considered embodiments, for example, the lance and spur may be co-supported on a spring-loaded push button that is operatively associated with the flap. When a user depresses the push button, the lance 66 and spur 68 are simultaneously thrust into the membrane 44 of the supplements cartridge 20. In this alternative embodiment, the flap can be closed without puncturing the membrane 44. Other embodiments are likewise possible.

In other contemplated variations, the indexable dispenser may be fitted with a ratchet mechanism that is coordinated with the circumferential expanse of each serving chamber 40. I.e., if the supplements cartridge 20 has twenty-eight serving chambers 40, the ratchet mechanism will enable twenty-eight stops or clicks per complete revolution. In this manner, rather than the cover 54 being freely rotatable about the central axis A, the cover 54 will rotationally advance one serving chamber 40 at a time into a perfectly centered condition under the dispensing window 60. Such a ratchet mechanism could take many different forms. In one example, the ratchet mechanism is keyed off the pedal-like shapes of the serving chamber sidewalls 36 so that the supplements cartridge 20 is indexed, one serving chamber 40 at a time, in a circular path inside the case. A user will be able to peer through the serving chamber window 60 to manually index the supplements cartridge 20 until an unused (i.e., un-punctured) serving chamber 40 is brought into view signifying that the underlying serving chamber 40 contains a full dose of powdered supplements S. In another example, the ratchet mechanism interacts with the spline cup 48. Other options naturally exist for the person of ordinary skill.

Figure 10:
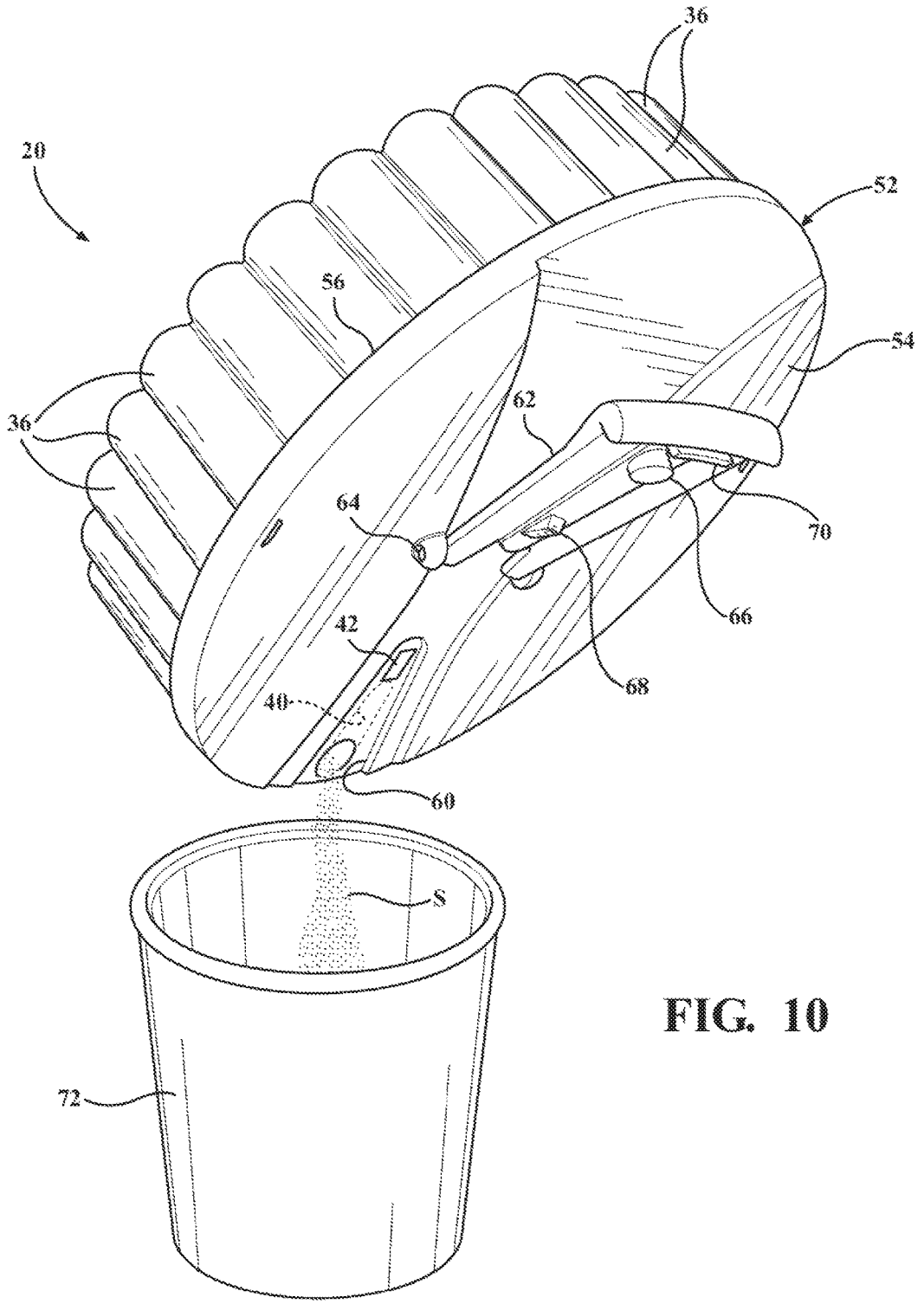
FIG. 10 is an illustration depicting the emptying of granulated nutritional supplements for a punctured serving chamber into a mixing vessel.
Figure 11:
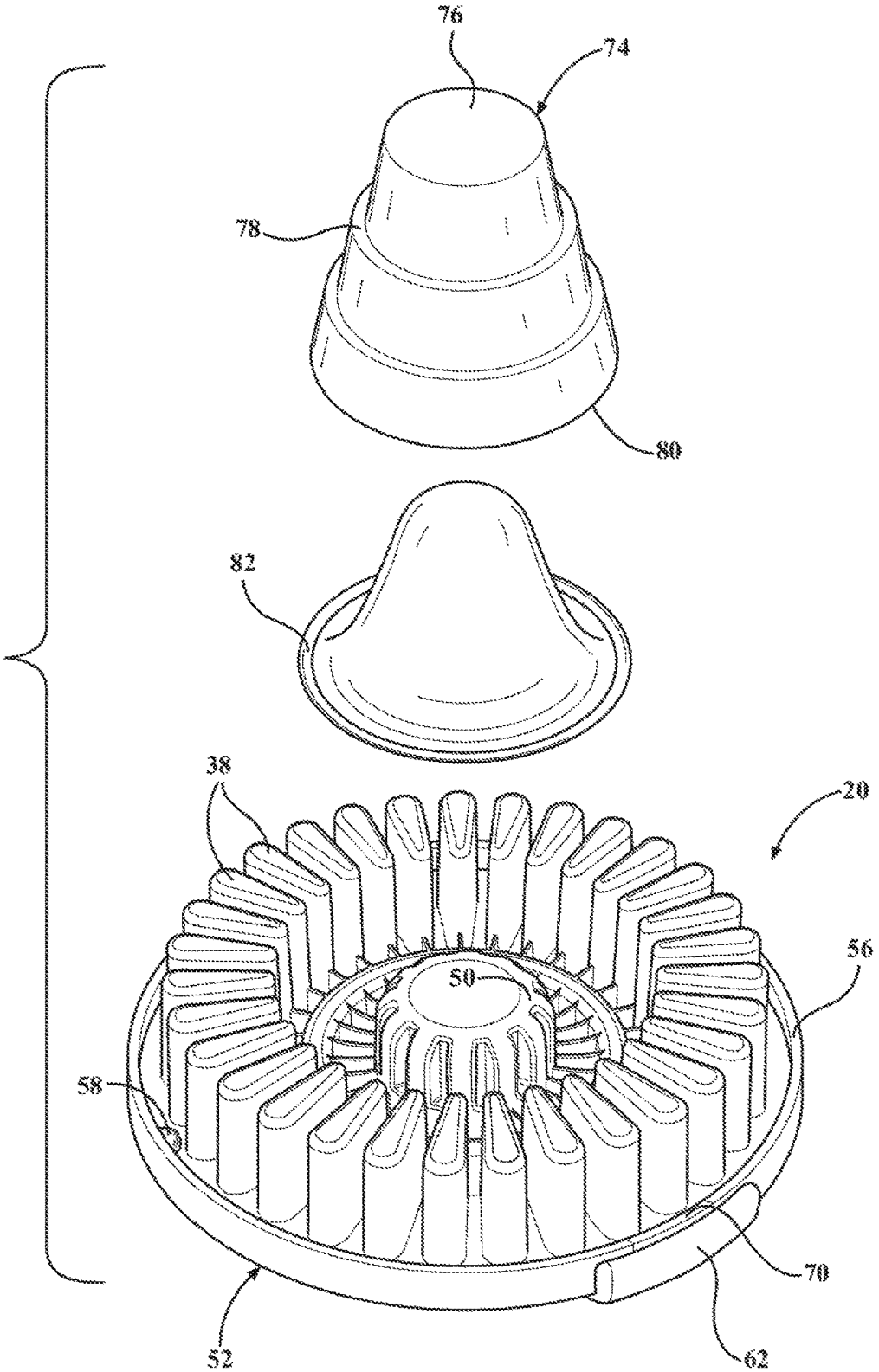
FIG. 11 is an exploded view showing an alternative embodiment in which a collapsible mixing cup is self-contained in the cavity region around the spline cup of the supplements cartridge.
Figure 12:
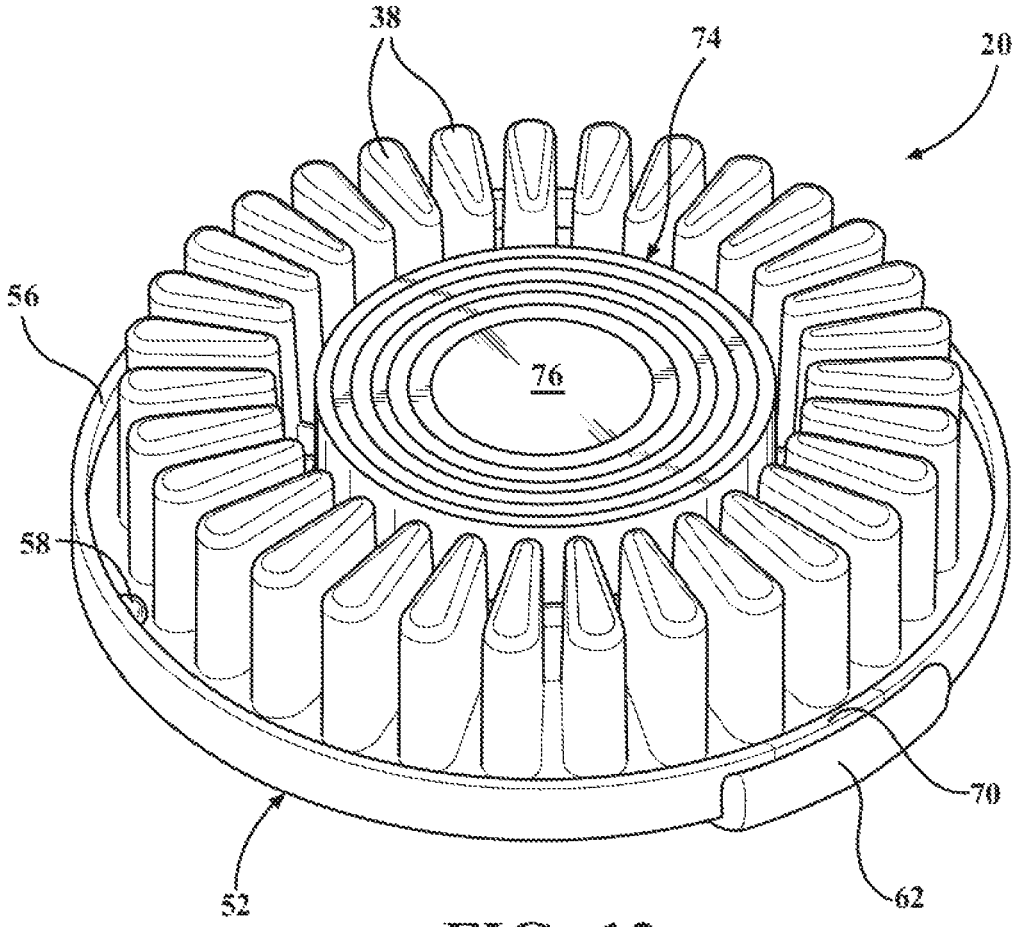
FIG. 12 is a perspective view as in FIG. 11 showing the self-contained mixing cup collapsed into the supplements cartridge in a travel-ready condition.

The indexable dispenser 52 may, optionally, include a self-contained mixing cup 74 as showing in FIGS. 11 and 12. The mixing cup 74 in this example has a closed base 76 and generally cylindrical sides 78 terminating in an open mouth 80. An interior region of the mixing cup 74 is of course configured to receive the granulated nutritional supplement S emptied from one of the serving chambers 40, as depicted for example in FIG. 10. The generally cylindrical sides 78 of the mixing cup 74 are axially collapsible, so that the collapsed mixing cup 74 can fit in the finger space around the outer surface 50 of the spline cup 48. In one embodiment, the mixing cup 74 is fabricated from a resilient material, such as silicone or other food-grade polymer, and the collapses about itself somewhat like an accordion. In another embodiment, the mixing cup 74 is fabricated from rigid frustoconical sections that self-lock when expanded somewhat akin to a compressible telescope or spy-glass. The mixing cup 74 may also include a cap 82 adapted to perfect a water-tight seal about the open mouth 80. The cap 82 may, optionally, be fabricated from a resilient material that snuggly seats with a light frictional fit into the cavity of the supplements cartridge 20 surrounding the spline cup 48. The cap 82 may be concave and adapted to overlie the outer surface 50 of the spline cup 48 as depicted in FIG. 11. Other options exist to incorporate a self-contained mixing cup. In one embodiment, the mixing vessel 74 is designed to hold approximately 3.4 fl oz of water (or other liquid), which quantity complies with current FAA regulations for carry-on luggage. In most instances, 3.4 fl oz of water will accommodate 1-2 doses of nutritional supplements from the cartridge 20.

To use the device 52 with a supplements cartridge 20 installed, the user unclasps and opens the flap 62, then spins the cover 54 until a fresh unused serving chamber 40 is exposed through the dispensing window 60. The user may stop at any available/unused serving chamber 40. If the user happens to open several serving chambers 40 in a non-sequential fashion with the indexable dispenser 52, and then transfers the partially used supplements cartridge 20 back to an automated dispensing unit like that described in WO 2015/073402, the processing system inside the automated dispensing unit will automatically find an unused available cell notwithstanding any discontinuity. After the user has manually positioned a fresh unused cell 40 within the dispensing window 60, the flap 62 is latched closed so that the lance 66 and spur 68 puncture the foil membrane 44. The flap 62 is once again opened, and the assembly 20, 52 inverted over a suitable mixing vessel 72, 74 as shown in FIG. 10. The user is encouraged to lightly shake or tap the assembly 20, 52 to make sure all of the powder S drains into the mixing vessel 72, 74. Water or other fluid is blended, as by stirring or shaking, with the nutritional supplements S in the mixing vessel 72, 74 before being consumed by the intended recipient.

Various added features are contemplated in association with the indexable dispenser 52, some of which may include an electrical power source such as batteries or a plug-in power cord. Such alternative variations include a battery-powered vibratory unit so that a user is not required to manually agitate when dispensing the nutritional supplements S. The vibratory unit can be controlled by a simple push-button switch. Another optional alternative embodiment may include a mixing vessel in the form of a travel carafe having an integrated blender feature. The blender feature could allow a user to mix a vitamin supplement into a concocted drink, such as a fruit smoothie.

In yet another variation, the indexable dispenser 52 could be equipped with a Wi-Fi transmitting/receiving device configured to operate on the popular Bluetooth protocol or any other suitable wireless communications strategy that enables connection to the internet, World Wide Web, or other desired network. One or more sensors could be incorporated into the indexable dispenser 52 to read the binary code indicia 46 and/or sense movement of the flap 62. The indexable dispenser 52 may also include a user interface, such as a keypad and/or touchscreen. The Wi-Fi transmitter could communicate with a secure website via wireless signal to record detailed information, such as what supplements were dispensed (via indicia 46), when the supplements were dispensed, how the supplements were dispensed (e.g., with water or blended in a concoction). Alternatively, these usage details could be manually recorded via a smartphone app or computer terminal. This provides the user, or the user's caregivers and other authorized individuals, the ability to manage dosing.

Along these lines, a website may be designed to permit push notifications to the smartphone app and/or to a user interface integrated into the indexable dispenser 52 which remind the user to take a supplement at a preferred time. For example, a graphic display screen affixed to the cover 54 might display a text message, or flash an indicator light. A speaker may be included in the indexable dispenser 52 to provide audible messages, or tones/beeps that communicate relevant information to the user. The programming may compute recommendations about re-ordering supplements based on actual usage. Specialized notifications can be sent to and from the user, a caregiver, and/or authorized health-care professionals via remote internet-connected devices communicating with the indexable dispenser 52.

Naturally, the various features and details of the several embodiments can be combined from among the examples in many different ways to configure any of the dispensing units with any of the functions by making modifications that should be readily apparent to those skilled in the art.

The foregoing invention has been described in accordance with the relevant legal standards, thus the description is exemplary rather than limiting in nature. Variations and modifications to the disclosed embodiment may become apparent to those skilled in the art and fall within the scope of the invention. Furthermore, particular features of one embodiment can replace corresponding features in another embodiment or can supplement other embodiments unless otherwise indicated by the drawings or this specification.

What is claimed is:

1. A granulated nutritional supplement dispensing assembly, said assembly comprising:

a supplements cartridge, said supplements cartridge having a generally annular frame centered about a central axis, said frame including a plurality of serving chambers, a volume of granulated nutritional supplement sealed in each of said serving chambers, each of said serving chambers including a fracturable element configured to be forcefully ruptured in order to extract the volume of granulated nutritional supplement therefrom, a plurality of marker zones spaced apart from said serving chambers, one respective said marker zone being associated with each said serving chamber, said marker zones configured to be physically altered with the forceful rupturing of said fracturable element, and a manually indexable dispenser coupled to said supplements cartridge and operative to open said serving chambers one-at-a-time to empty the granulated nutritional supplement therefrom.

2. The assembly of claim 1, wherein said frame of said supplements cartridge has an outer peripheral flange, and wherein said indexable dispenser comprises a cover overlying at least a plurality of said serving chambers, said cover having an outer rim, said outer rim at least partially encircling said peripheral flange of said supplements cartridge.

3. The assembly of claim 2, wherein at least two cleats extend inwardly from said outer rim, said cleats adapted to seat behind said peripheral flange in order to rotationally retain said indexable dispenser to said supplements cartridge.

4. The assembly of claim 1, wherein said cover includes a dispensing window shaped and dimensioned to expose a select one of said serving chambers while the adjacent serving chambers remain hidden behind said cover.

5. The assembly of claim 4, wherein said indexable dispenser includes a flap supported on said cover for movement between an open position exposing said dispensing window and a closed position covering said dispensing window.

6. The assembly of claim 5, wherein said flap is pivotally connected to said cover.

7. The assembly of claim 5, wherein said fracturable element of said supplements cartridge comprises a punctureable membrane covering said serving chambers, said membrane further covering each of said marker zones, said flap having a lance configured to breach said membrane in a region overlaying a select one of said serving chambers of said supplements cartridge.

8. The assembly of claim 7, wherein said flap further includes a spur, said spur configured to puncture said membrane in a region overlaying one of said marker chambers.

9. The assembly of claim 5, wherein said flap includes a clasp for securing said flap in said closed position covering said dispensing window.

10. The assembly of claim 1, wherein said supplements cartridge includes a spline cup centered along said central axis, an outer surface of said spline cup being configured as a graspable handle, and said assembly further including a mixing cup having a closed base and generally cylindrical sides terminating in an open mouth, an interior region of said mixing cup configured to receive said granulated nutritional supplement emptied from one of said serving chambers, said mixing cup being fabricated from a resilient material, said generally cylindrical sides being axially collapsible around said outer surface of said spline cup for storage when not in use.

11. The assembly of claim 10, wherein said mixing cup includes a cap adapted to perfect a water-tight seal about said open mouth, said cap being fabricated from a resilient material, said cap being concave and adapted to overlie said outer surface of said spline cup.

12. A manually indexable dispenser adapted to be coupled to an annular nutritional supplements cartridge having a plurality of serving chambers each sealed by a membrane to store a volume of granulated nutritional supplement, said indexable dispenser comprising:

a generally annular cover, said cover having an outer rim, said outer rim adapted to at least partially encircle the supplements cartridge, said cover including a dispensing window shaped and dimensioned to expose a select one of the serving chambers in the supplements cartridge while the adjacent serving chambers remain hidden behind said cover, a flap supported on said cover for movement between an open position exposing said dispensing window and a closed position covering said dispensing window, said flap having a lance configured to breach the membrane in a region overlaying a select one of the serving chambers of the supplements cartridge, said flap further including a spur, said spur configured to puncture the membrane in a defined region.

13. The indexable dispenser of claim 12, wherein said outer rim includes at least two cleats, each said cleat extending inwardly from said outer rim, said cleats adapted to seat behind a peripheral flange of the supplements cartridge in order to rotationally retain said indexable dispenser to the supplements cartridge.

14. The indexable dispenser of claim 12, wherein said flap includes a clasp for securing said flap in said closed position covering said dispensing window.

15. The indexable dispenser of claim 12, wherein said dispensing window has a sector shape.

16. The indexable dispenser of claim 12, wherein said flap is pivotally connected to said cover.

17. A granulated nutritional supplement dispensing assembly, said assembly comprising:

a supplements cartridge, said supplements cartridge having a disk-shaped frame centered about a central axis, said frame including an outer peripheral flange, said frame including a plurality of chamber openings arranged in equal radial and circumferential increments about said central axis, sidewalls surrounding each chamber opening and extending generally perpendicularly from said frame, said sidewalls for each respective chamber opening covered by a closed end to form a serving chamber behind each chamber opening, a generally equal volume and composition of granulated nutritional supplement disposed in each said serving chamber, a plurality of marker zones spaced apart from said serving chambers, one said marker zone being associated with each said serving chamber, a spline cup affixed to said frame, said spline cup including a plurality of axially extending interior splines, an outer surface of said spline cup configured as a graspable handle, a punctureable membrane disposed in surface-to-surface relationship over said chamber openings and said marker zones of said frame, a manually indexable dispenser coupled to said supplements cartridge and operative to open said serving chambers one-at-a-time to empty the granulated nutritional supplement therefrom, said indexable dispenser comprising a cover overlying at least a plurality of said serving chambers, said cover being generally annular, said cover having an outer rim at least partially encircling said peripheral flange of said supplements cartridge, said cover including a dispensing window shaped and dimensioned to expose a select one of said serving chambers while the adjacent serving chambers remain hidden behind said cover, a flap supported on said cover for movement between an open position exposing said dispensing window and a closed position covering said dispensing window, said flap having a lance configured to breach said membrane in a region overlaying a select one of said serving chambers of said supplements cartridge, said flap further including a spur configured to puncture said membrane in a region overlaying one of said marker chambers, said flap including a clasp for securing said flap in said closed position covering said dispensing window.

18. The assembly of claim 17, further including at least two cleats extending inwardly from said outer rim, said cleats adapted to seat behind said peripheral flange in order to rotationally retain said indexable dispenser to said supplements cartridge.

19. The assembly of claim 17, wherein each said chamber opening has a radially widening shape, and wherein said dispensing window has a sector shape corresponding generally to said radially widening shape of each said chamber opening.

20. The assembly of claim 17, further including a mixing cup having a closed base and generally cylindrical sides terminating in an open mouth, an interior region of said mixing cup configured to receive said granulated nutritional supplement emptied from one of said serving chambers, said mixing cup being fabricated from a resilient material, said generally cylindrical sides being axially collapsible around said outer surface of said spline cup for storage when not in use.

* * * * *